United States Patent [19]

Decker, Jr. et al.

[11] Patent Number: 4,640,392

[45] Date of Patent: Feb. 3, 1987

[54] ACCESSORY BAG FOR CONTAINERS

[75] Inventors: Joseph A. Decker, Jr., Katy; Joseph F. Fiore, Jr.; Stanley A. Katz, both of Houston, all of Tex.

[73] Assignee: Igloo Corporation, Houston, Tex.

[21] Appl. No.: 732,348

[22] Filed: May 8, 1985

[51] Int. Cl.[4] ..... A45C 11/20; A45C 13/28; B65D 21/00

[52] U.S. Cl. ..... 190/108; 190/102; 190/111; 206/541; 220/23.83; 220/85 R; 383/37

[58] Field of Search ..... 190/102, 108, 110, 111, 190/26; 220/85 R, 23.83; 206/541, 546–548; 383/37; 224/32 A; D7/77

[56] References Cited

U.S. PATENT DOCUMENTS

| | | | |
|---|---|---|---|
| 537,178 | 4/1895 | Blalock | 206/541 X |
| 656,707 | 8/1900 | Welshe | 190/26 |
| 796,286 | 8/1905 | Botteese | 190/26 |
| 930,032 | 8/1909 | Billburg et al. | 190/108 |
| 2,574,786 | 11/1951 | Hiatt | 190/110 X |
| 2,813,602 | 11/1957 | MacArthur, Jr. | 190/110 X |
| 3,352,391 | 11/1967 | Vaugham | 190/111 |
| 3,482,418 | 12/1969 | Moore | 206/547 X |
| 3,729,038 | 4/1973 | Ekeson | 190/110 X |
| 3,786,972 | 1/1974 | Alley | 224/32 A X |
| 3,837,447 | 9/1974 | Honan | 190/110 |
| 4,258,869 | 3/1981 | Hilgendorff | 224/32 A |
| 4,301,898 | 11/1981 | Plough et al. | 190/102 |
| 4,390,088 | 6/1983 | Brenner | 224/32 A X |

*Primary Examiner*—William Price
*Assistant Examiner*—Sue A. Weaver
*Attorney, Agent, or Firm*—Vinson & Elkins

[57] ABSTRACT

A flexible accessory bag (35) for releasable attachment to a lid or cover (20) on a container (10), such as an ice chest or cooler, which is pivoted between open and closed positions of the container (10). The accessory bag (35) has a pair of opposed ends (36, 38) which are secured by elastic bands (54, 56) to opposed lid ends (27, 28) and a pair of zippered pockets (40, 42) secured to the bag ends (36, 38) extend over the lid (20).

6 Claims, 10 Drawing Figures

ACCESSORY BAG FOR CONTAINERS

BACKGROUND OF THE INVENTION

This application relates to an accessory bag for fitting on a container, and more particularly to such an accessory bag for releasably fitting on a cover or lid mounted over the upper open end of the container for pivotal movement between open and closed positions.

Heretofore, containers such as luggage or briefcases have been provided with removable accessory bags such as illustrated, for example, in U.S. Pat. Nos. 2,574,786; 2,813,602; 3,729,038; and 3,837,447. However, such accessory bags have been in the nature of a pair of hinged saddle bags which fit over the top of the container and drape along two opposed sides. Normally an opening is provided in the portion connecting the two bags and the handle of the container is received in such opening which holds or assists in holding the accessory bags in position on the container. Thus, prior accessory bags have fitted about opposed sides of a container and were not mounted on a lid or cover of a container for movement with the lid between open and closed positions of the container.

U.S. Pat. No. 3,837,447, for example, shows a luggage accessory attachment removably secured to a conventional attache case and comprising a pair of opposed zippered bags connected together by a flexible web fitting around the bottom of the attache case. Flaps extending from the bags overlap the top of the attache case and are detachably connected to each other around and through the handle for the attache case. Thus, the pair of bags are secured about the handle and opposed sides of the case.

SUMMARY OF THE INVENTION

The accessory bag comprising the present invention is particularly adapted for fitting on a lid or cover which is mounted over the open upper end of a container for pivotal movement between open and closed positions of the container. Such a lid or cover is normally mounted for pivotal movement about opposed sides of a generally rectangular container centrally of the width thereof. The lid has a pitched or dome-like body over the open end of the container and a pair of opposed integral parallel ends which extend alongside the opposed sides of the container. The lid ends are pivotally mounted on the opposed container sides and the dome-like lid body is so constructed and configured as to clear the upper edges of the container sides as the lid moves between open and closed positions.

The container is normally formed from a generally rigid plastic material while the accessory bag is formed of a flexible material, for example, nylon, cloth, sheet plastic, or similar fabric-like material. The flexible accessory bag is mounted on the lid for pivotal movement therewith between open and closed positions of the lid, and the accessory bag has at least one compartment therein adapted to carry selected accessory articles. The accessory bag has a pair of ends which are adapted to fit in generally parallel relation alongside the pair of opposed ends of the lid, and to be releasably secured to the lid ends by elastic bands or straps on the bag ends. A pair of elongate spaced parallel pockets on the bag are secured between the bag ends and fit over the lid body receiving the handle of the lid therebetween. Each of the pockets has a zippered opening to permit access to the pockets to secure articles therein.

It is an object of this invention to provide an accessory bag which may be removably secured to a container, such as an ice chest or cooler, with the accessory bag having compartments for carrying selected articles therein.

It is a further object of the invention to provide a flexible accessory bag which is removably positioned on a lid or cover for a container which is pivotally moved between open and closed positions for providing access to the container.

A further object of the invention is to provide such a flexible bag having a pair of ends thereon with elastic bands for removably securing the accessory bag to opposed ends of the lid, thereby to hold the bag in releasably secured position on the lid.

A further object of the invention is to provide such a removable accessory bag for an ice chest or cooler which includes a pocket positioned on the lid of the ice chest adjacent each side of the handle, and an additional pouch along a side or end of the ice chest, each for carrying various selected articles, such as keys, wallets, magazines, sunglasses, tanning lotion, and the like.

Other objects and advantages of this invention are apparent by reference to the accompanying drawings in which.

Figure 1:
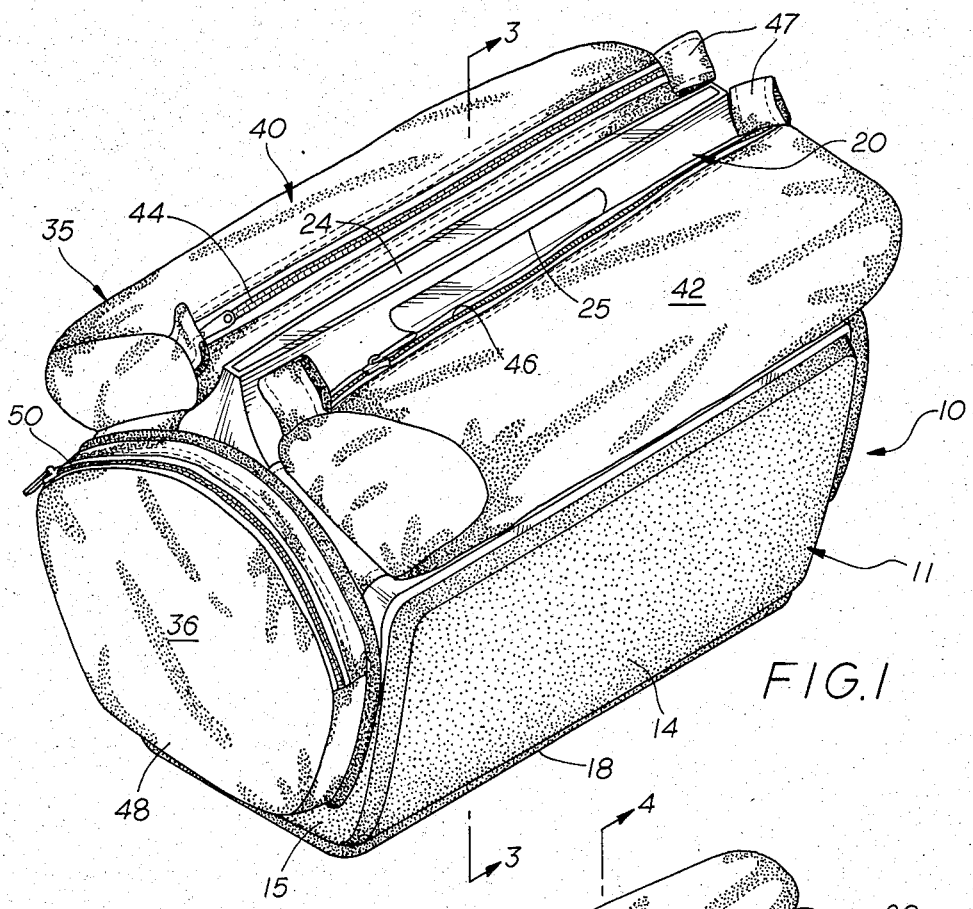
FIG. 1 is a perspective view of a container having a pivoted lid thereon shown in closed position with the accessory bag comprising the present invention removably secured to the lid for movement therewith between open and closed positions of the container.
Figure 2:
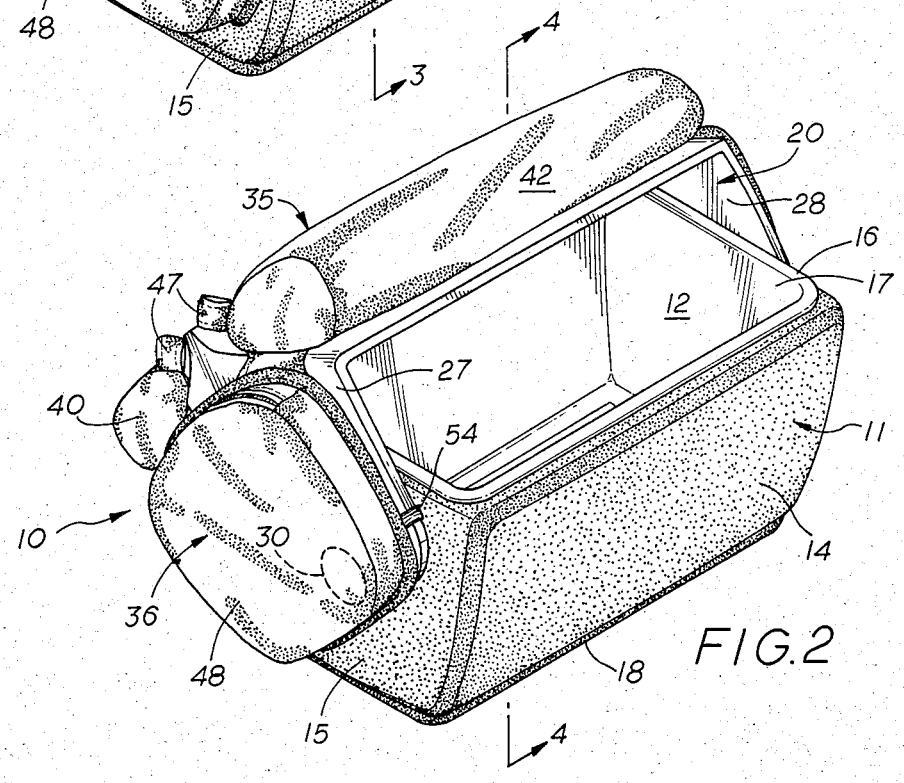
FIG. 2 is a perspective view similar to FIG. 1 but showing the lid and accessory bag thereon pivoted to the open position of the container.

Referring now to the drawings for a better understanding of the invention, a container is indicated generally at 10 and is shown as an ice chest or cooler for holding ice, drinks, and the like for human consumption. Container 10 is of a generally rectangular shape and includes a main body comprising an outer shell 11 and an inner shell 12 formed of a generally rigid plastic material and separated by suitable insulation 13. Inner shell 12 has an inner hard finish suitable for contact with food or the like. Outer shell 11 defines opposed pairs of sides 14 and 15 of container 10, and inner shell 12 defines an upper lip or edge 16 forming the upper open end 17 of container 10. Bottom 18 of container 10 connects sides 14 and 15.

Figure 3:
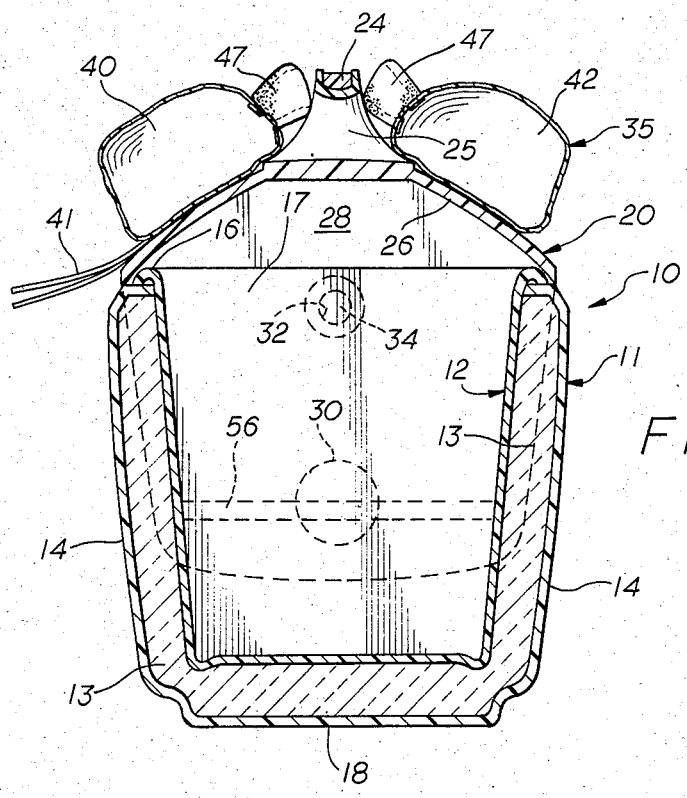
FIG. 3 is a section view taken generally along line 3—3 of FIG. 1 and showing the contour of the dome-like lid and accessory bag in closed position.
Figure 4:
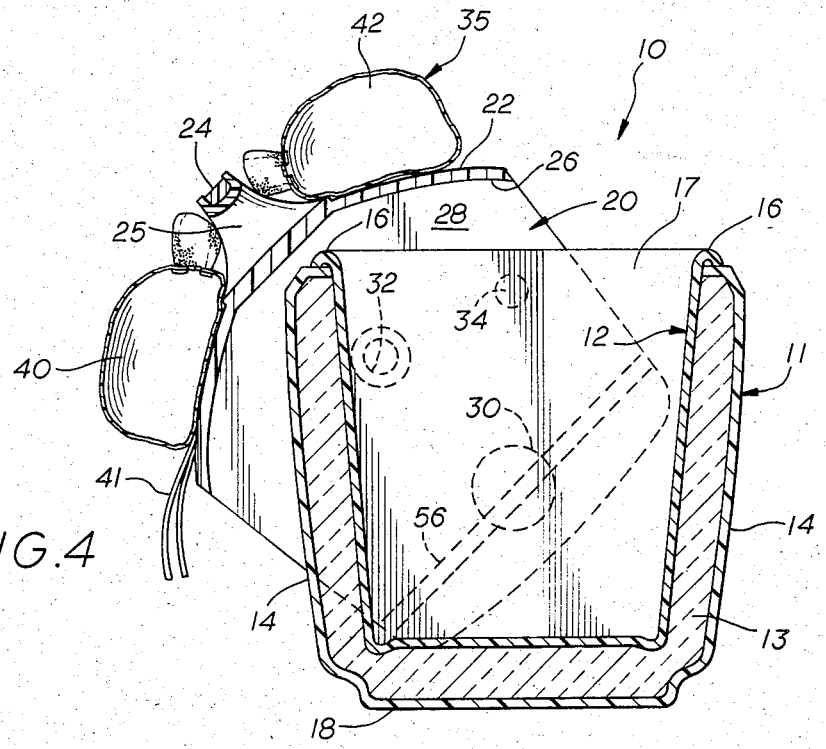
FIG. 4 is a section view taken generally along line 4—4 of FIG. 2 showing the lid and accessory bag in an open position.

A unitary or one-piece lid or cover of the container generally indicated 20 has a main body 22 of a pitched or dome-shape with an elongate carrying handle 24 projecting from the apex of pitched body 22 and defining an elongate opening 25 extending along the length of body 22 for gripping and carrying container 10. The pitched lid body 22 has a generally concave inner surface 26 as shown particularly in FIGS. 3 and 4 in order to clear upper lip or edge 16 of inner shell 12 upon movement of lid 20 to open position. Lid 20 includes a pair of opposed ends 27 and 28 formed integrally with body 22. Ends 27, 28 are pivoted at 30 to opposed sides 15 centrally of the width thereof. End 27 has a recessed opening 32 therein which receives a pushbutton 34 mounted on adjacent side 15 and spring urged outwardly. Pushbutton 34 when received within opening 32 holds lid 20 in closed position. To release lid 20 for pivotal movement to open position, pushbutton 34 is manually depressed inwardly against spring bias to remove pushbutton 34 from opening 32, thereby to permit pivoting of lid 20 to the open position of container 10 providing access thereto. Lid 20 is moved manually by gripping of handle 24 after depression of pushbutton 34. Since the inner surface 26 of body 22 is pitched and of a generally concave contour, upper edge 16 is cleared upon pivoting of lid 20 between open and closed positions.

Figure 5:
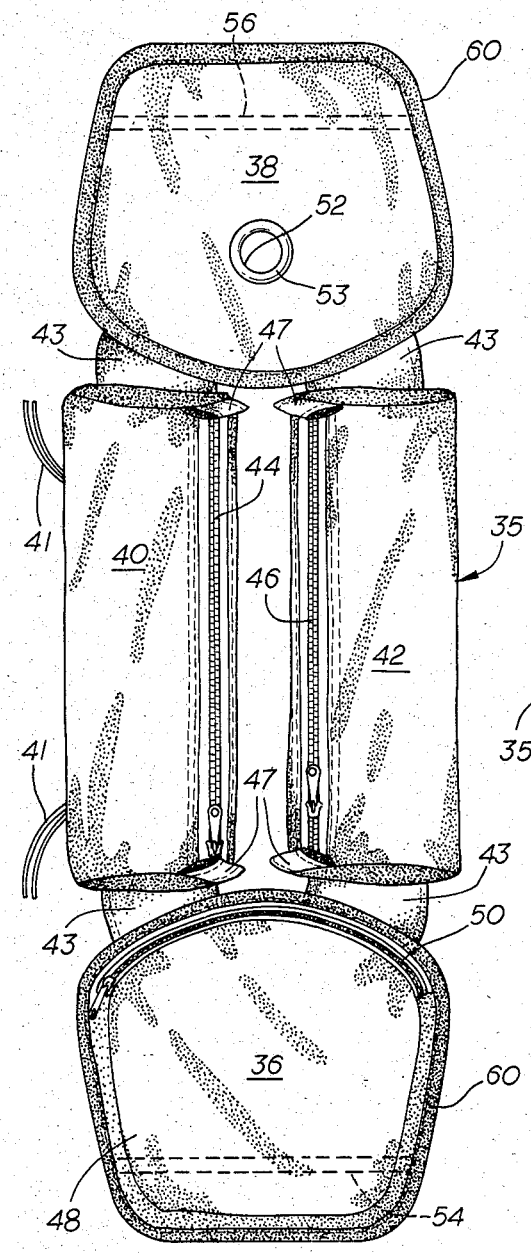
FIG. 5 is a top plan of the accessory bag removed from the container showing the two opposed ends connected by a pair of spaced pockets.
Figure 6:
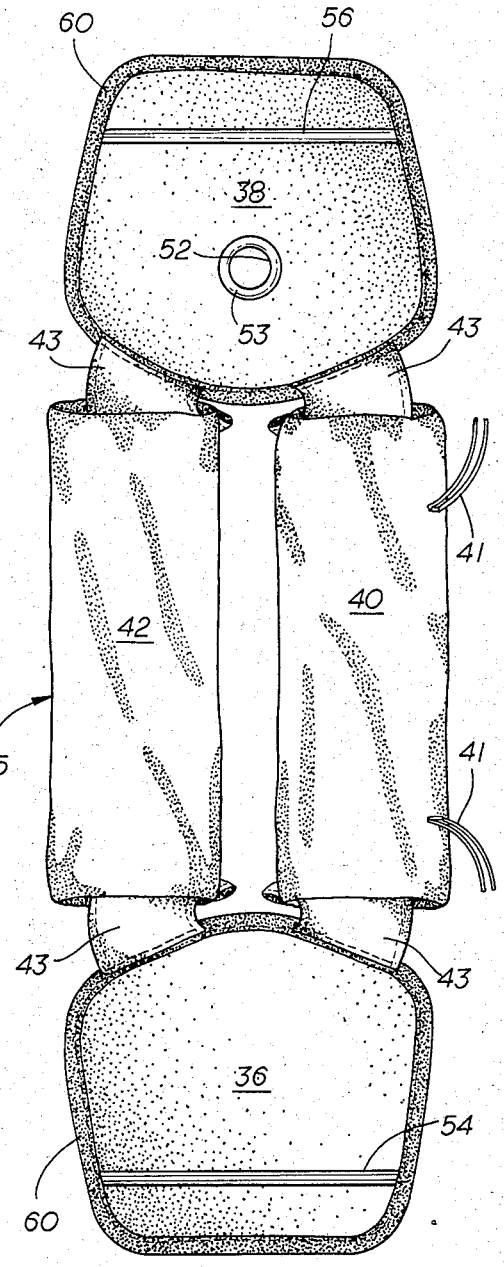
FIG. 6 is a bottom plan of the accessory bag shown in FIG. 5.
Figure 7:
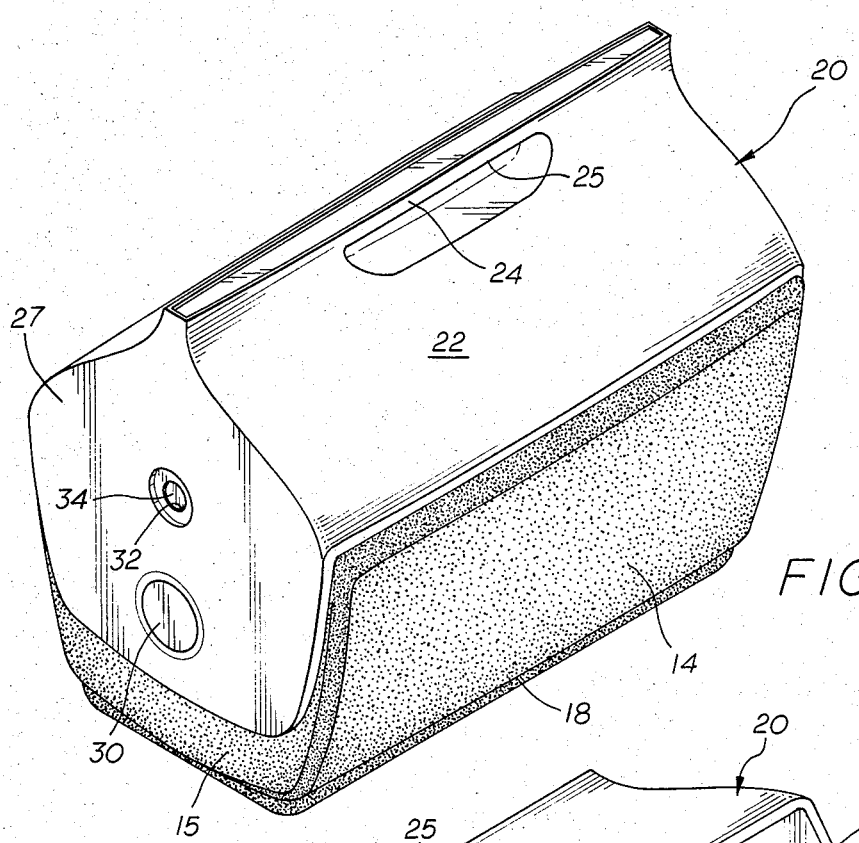
FIG. 7 is a perspective of the container with the accessory bag removed therefrom and illustrating the lid in its closed position.
Figure 8:
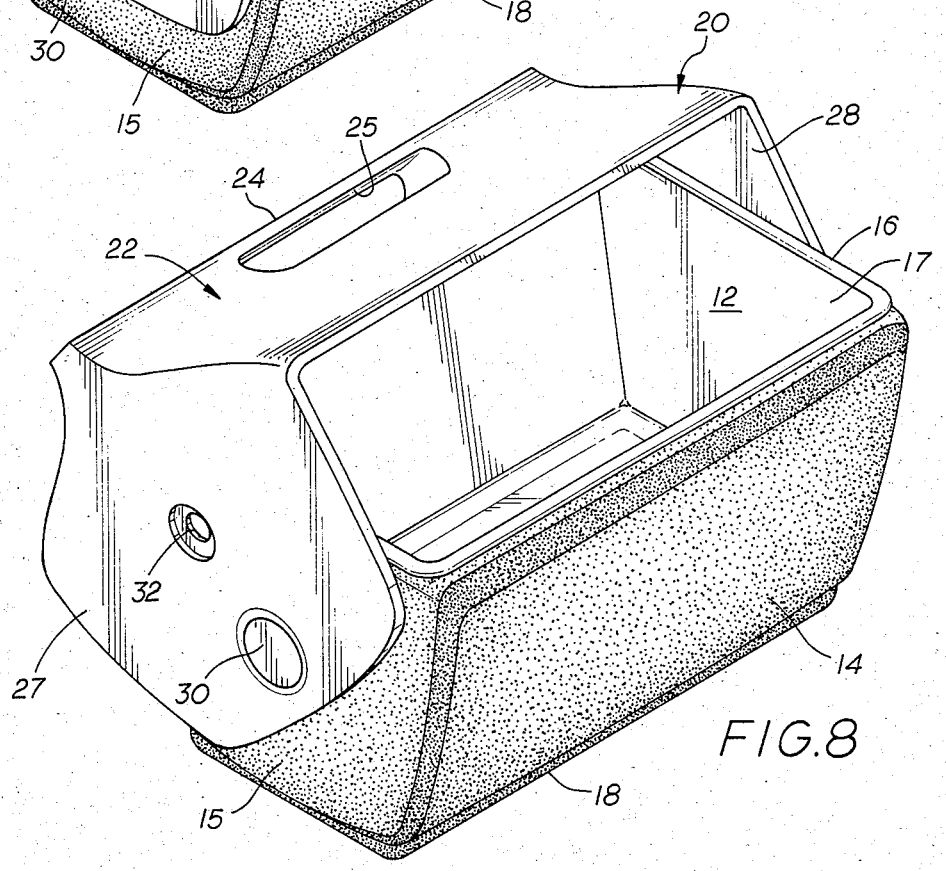
FIG. 8 is a perspective view of the container similar to FIG. 7 but showing the lid pivoted to an open position.

The present invention comprises a one-piece or unitary accessory bag generally indicated at 35 and particularly adapted for use with a container such as container 10 having a pivoted lid or cover thereon similar to lid 20. Referring first to FIGS. 5 and 6 in which accessory bag 35 is shown removed from container 10, two opposed ends 36 and 38 are provided which are connected by a pair of spaced elongated pockets 40, 42 arranged in parallel spaced relation to each other. Pocket 40 has a pair of spaced string ties 41 thereon which may be tied about an elongate article, such as a flashlight or tennis racquet for carrying such article.

Connecting flaps 43 are sewn or stitched to pockets 40, 42 and the associated ends 36, 38. Zippered openings 44, 46 are provided in respective pockets 40, 42 and extend along substantially the entire length of pockets 40, 42. A loop 47 is provided at each end of each zippered opening 44, 46 for gripping upon opening or closing of a respective pocket 40, 42. One end 36 has a pouch 48 thereon which contains a zippered opening 50 adjacent its upper end. End 38 has a central opening 52 therein defined by a plastic ring 53 secured to end 38. Respective elastic bands or straps 54, 56 are secured across ends 36, 38.

Ends 36, 38 are formed of a thin hard plastic material and have a strip of nylon 60 looped about their edges and stitched thereto to form a border with a pleasing appearance. Pouch 48 is stitched to the outer surface of end 36 and a sheet of material similar to that of pouch 48 is stitched to the outer surface of end 38 thereby to provide a similar appearance to both ends 36, 38 of bag 35.

To secure accessory bag 35 onto lid 20, elongate pockets 40, 42 are first positioned on the upper surface of lid 20 with ends 36, 38 positioned in parallel relation to lid sides 15. End 38 which has opening 52 therein is positioned on end 15 having depressible pushbutton 24 thereon with opening 52 in axial alignment with opening 32 so that access to pushbutton 34 may be provided for manually depressing button 34. With bag ends 36, 38 adjacent lid ends 26, 28 elastic bands 54, 56 are positioned about lid ends 26, 28, thereby to secure accessory bag 35 in position with handle 24 projecting between pockets 40, 42.

From the above, it is understood that a removable accessory bag 35 has been provided by the present invention which is removably secured to a pivoted lid of a cooler or ice chest, for example. Such an accessory bag eliminates the need for carrying an extra bag for picnic or beach trips, for example. Elongate pockets 40, 42 on the top of container 10 have zippered openings 44, 46 adjacent handle 24 which is positioned between spaced pockets 40, 42. An end pouch 48 formed on bag end 36 likewise has a zippered opening 50 which permits articles, such as sunglasses or tanning lotion, to be carried therein. Accessory bag 35 is formed preferably of nylon coated with polyvinylchloride (PVC), which is a durable, lightweight, washable, waterproof, and fade-resistant material. Other flexible materials having similar characteristics may be employed, if desired.

Figure 9:
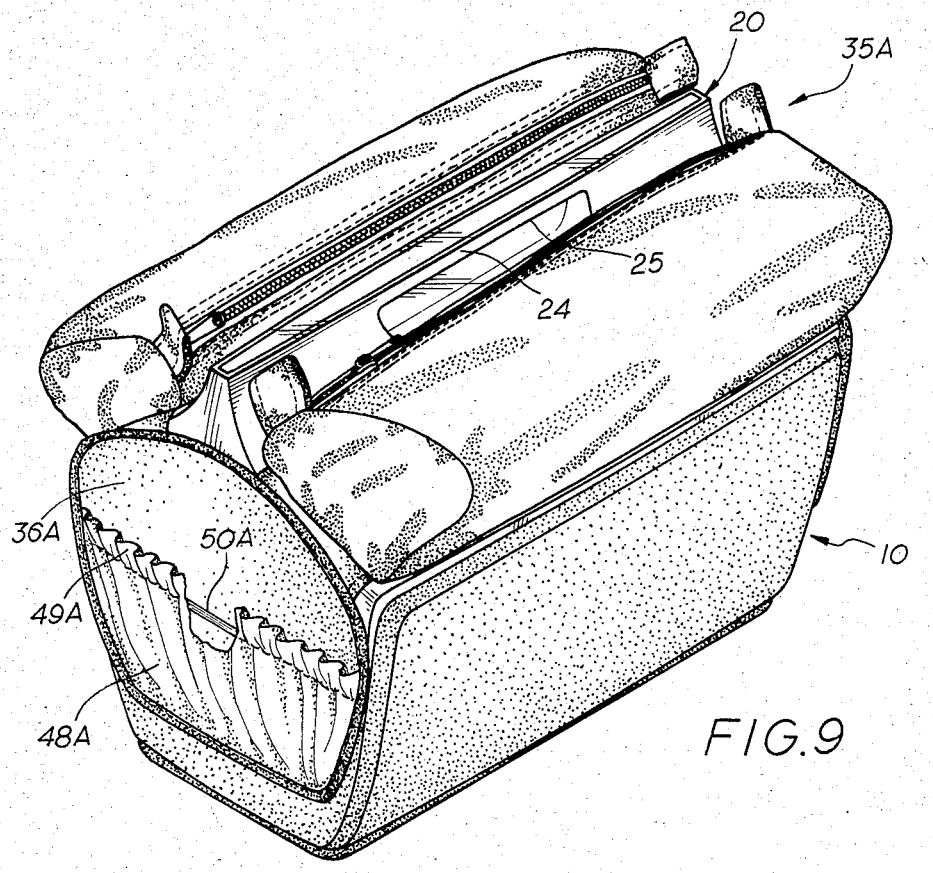
FIG. 9 is a perspective of a separate embodiment of the invention showing the accessory bag in which one bag end has a pouch with an open upper end drawn tight against the bag end by an elastic band.
Figure 10:
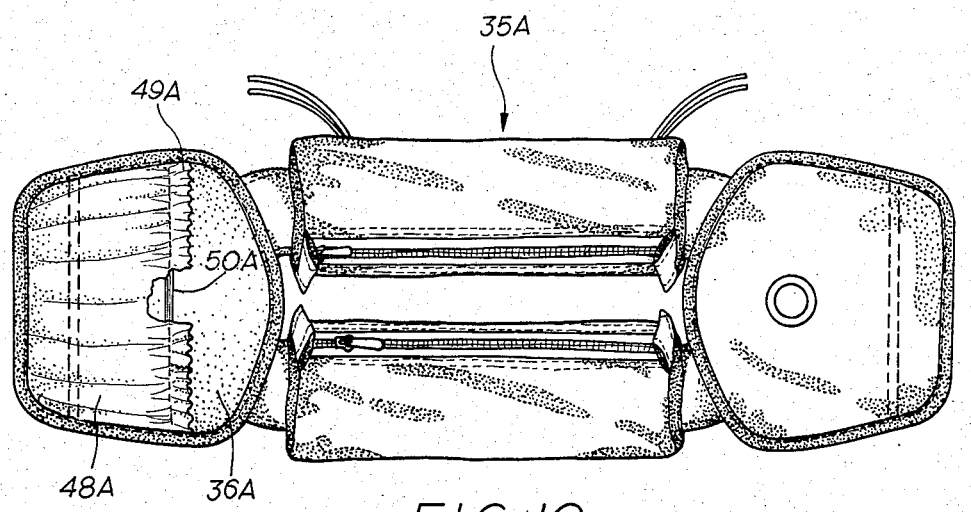
FIG. 10 is a top plan of the accessory bag of FIG. 9 shown removed from the container.

Referring to FIGS. 9 and 10, a further embodiment of an end for accessory bag 35A is illustrated in which end 36A has a pouch 48A with an open upper end that is stitched to form a puckered or ruffled marginal edge portion 49A. An elastic band 50A extends along the inner surface of marginal edge portion 49A to draw the open upper end of pouch 48A tight against end 36A for closing the upper end. Thus, easy access to pouch 48A is provided by elastic strap or band 50A when it is desired to remove an article from pouch 48A. The remainder of bag 35A other than pouch 48A is identical to bag 35 of the embodiment shown in FIGS. 1–8.

What is claimed is:

1. In a generally rectangular container having two opposed pairs of sides defining an open upper end, and a bottom extending between the sides to form a container body, a lid pivotally mounted on the container body having a pitched dome-like body forming a generally concave inner surface extending over said open end and a pair of opposed generally parallel ends secured to said dome-like body and extending alongside one opposed pair of sides on said container, and a handle projecting from the apex of said pitched body and having a elongate opening extending along the length of the container, said lid ends being mounted for pivotal movement on said opposed pair of sides for pivoting of said lid from a closed position in which the dome-like body covers said open upper end to an open position in which the dome-like body is removed from said open upper end to fully expose said open end, said dome-like body being of an inner shape and configuration to clear the upper portion of said container sides upon pivotal movement to open position;

the improvement of a flexible accessory bag mounted on the outer surface of the dome-like lid for pivotal movement therewith between said open and closed positions, said accessory bag comprising:

a pair of spaced elongate pockets arranged in parallel spaced relation to each other and receiving said handle therebetween, said pockets having openings to provide access thereto and means for selectively closing said openings;

a pair of opposed ends fitting over said lid ends and including means for releasably mounting the accessory bag on the lid for movement therewith; and flexible connections between said pockets and said bag ends to permit folding movement of said bag ends relative to said pockets.

2. The combination set forth in claim 1 wherein one of said bag ends has a central opening therethrough adapted to provide access to a depressible button for releasing the lid.

3. The combination set forth in claim 1 wherein at least one of said bag ends has a pouch thereon adapted to receive accessory articles.

4. The combination set forth in claim 1 wherein said means for selectively closing said pocket openings comprises zippers to permit access to said pockets and to secure selected articles therein.

5. The combination set forth in claim 1 wherein said means for releasably mounting the accessory bag to said lid comprises elastic bands about the ends of said lid.

6. The combination set forth in claim 1 wherein at least one of said pockets has a pair of spaced string ties thereon adapted to be secured about an elongate accessory article for securement of said article.

* * * * *